US009938720B2

(12) United States Patent
Urheim

(10) Patent No.: US 9,938,720 B2
(45) Date of Patent: Apr. 10, 2018

(54) SUPPORT STRUCTURE MODULE AND MODULAR BEAM STRUCTURE

(71) Applicant: IPI Access AS, Stavanger (NO)

(72) Inventor: Lars Urheim, Stavanger (NO)

(73) Assignee: IPI Access AS, Stavanger (NO)

( * ) Notice: Subject to any disclaimer, the term of this patent is extended or adjusted under 35 U.S.C. 154(b) by 0 days.

(21) Appl. No.: 15/034,205

(22) PCT Filed: Oct. 30, 2014

(86) PCT No.: PCT/NO2014/050206

§ 371 (c)(1),
(2) Date: May 4, 2016

(87) PCT Pub. No.: WO2015/065200

PCT Pub. Date: May 7, 2015

(65) Prior Publication Data

US 2016/0281362 A1 Sep. 29, 2016

(30) Foreign Application Priority Data

Nov. 4, 2013 (NO) ..... 20131460

(51) Int. Cl.
*E04B 1/19* (2006.01)
*E04C 3/00* (2006.01)
(Continued)

(52) U.S. Cl.
CPC ..... *E04C 3/005* (2013.01); *E04C 3/04* (2013.01); *E04C 3/32* (2013.01); *E04H 3/28* (2013.01);
(Continued)

(58) Field of Classification Search
CPC ..... E01D 15/124; E04C 3/005; E04C 2003/0495; B64G 1/222; E04H 12/187; E04H 3/28; E04B 1/3441; E04B 1/3445
See application file for complete search history.

(56) References Cited

U.S. PATENT DOCUMENTS 3,091,816 A 6/1963 Wetzel
3,398,850 A * 8/1968 Kennard ..... B65D 88/524 217/14
(Continued)

FOREIGN PATENT DOCUMENTS

EP 0 144 471 5/1985
EP 0288323 2/1993
(Continued)

OTHER PUBLICATIONS

International Search Report, PCT/NO2014/050206, dated Jan. 30, 2015.
(Continued)

*Primary Examiner* — Gisele D Ford
(74) *Attorney, Agent, or Firm* — Andrus Intellectual Property Law, LLP

(57) ABSTRACT

A modular beam structure consisting of one or more collapsible, lockable and interconnectable support structure modules, and any transition module to change longitudinal direction of the structure. In addition, it is possible to attach onto one or more support structure modules a collapsible platform and/or wall or fence. The structure is at an upstream end or start end attachable, via a module end element, onto an attachment device, e.g. a wall or attachment block, via a support frame which is fixedly attached to the attachment device.

20 Claims, 16 Drawing Sheets

(51) Int. Cl.

| | |
|---|---|
| ***E04H 3/28*** | (2006.01) |
| ***E04C 3/04*** | (2006.01) |
| ***E04C 3/32*** | (2006.01) |
| *E01D 6/00* | (2006.01) |
| *E01D 15/12* | (2006.01) |

(52) U.S. Cl.
CPC ..... *E01D 6/00* (2013.01); *E01D 15/124* (2013.01); *E04C 2003/0486* (2013.01); *E04C 2003/0495* (2013.01)

(56) References Cited

U.S. PATENT DOCUMENTS 3,600,869 A * 8/1971 Petroff ..... E04B 1/19 52/330
4,026,221 A 5/1977 Wilson et al.
4,527,362 A * 7/1985 Tobey ..... B64G 9/00 52/646
4,539,786 A * 9/1985 Nelson ..... B64G 9/00 244/159.5
4,569,176 A * 2/1986 Hedgepeth ..... B64G 9/00 182/152
4,587,777 A 5/1986 Vasques
4,644,628 A * 2/1987 Coppa ..... E04C 3/02 29/429
4,819,399 A * 4/1989 Onoda ..... B64G 9/00 52/645
4,912,887 A * 4/1990 Sullivan ..... E04H 3/28 52/646
4,958,474 A * 9/1990 Adams ..... E04H 12/185 52/108
5,016,418 A * 5/1991 Rhodes ..... B64G 9/00 403/72
5,040,349 A * 8/1991 Onoda ..... B64G 9/00 52/645
5,050,353 A * 9/1991 Rogers ..... E04H 3/28 52/118
5,228,258 A * 7/1993 Onoda ..... B64G 9/00 343/915
6,076,770 A * 6/2000 Nygren ..... B64G 9/00 244/159.5
6,598,351 B2 * 7/2003 Hallberg ..... E04H 3/123 52/6
7,237,749 B2 * 7/2007 Ritts ..... B61D 17/046 244/117 R
2003/0041548 A1 * 3/2003 Merrifield ..... B64G 1/222 52/646
2004/0000117 A1 * 1/2004 Schipani ..... A47F 5/13 52/636
2004/0000620 A1 * 1/2004 Schipani ..... A47F 5/13 248/50
2004/0111999 A1 * 6/2004 Schipani ..... A47F 5/13 52/646
2004/0144055 A1 * 7/2004 Lewison ..... E04C 3/08 52/633
2005/0055946 A1 * 3/2005 Schipani ..... G09F 15/0068 52/633
2005/0126106 A1 * 6/2005 Murphy ..... B64G 1/222 52/652.1
2006/0010821 A1 * 1/2006 Schipani ..... A47F 5/13 52/641
2006/0107611 A1 5/2006 Merrifield
2007/0044415 A1 * 3/2007 Merrifield ..... E04B 1/3441 52/633
2007/0145195 A1 * 6/2007 Thomson ..... B64G 1/222 244/172.6
2008/0283670 A1 * 11/2008 Harvey ..... B64G 1/222 244/172.6
2009/0199503 A1 * 8/2009 Liew ..... E04B 1/19 52/646
2009/0224129 A1 * 9/2009 Urheim ..... A47B 3/06 248/346.3
2010/0064624 A1 * 3/2010 Dodd ..... E04C 3/005 52/646
2010/0269446 A1 10/2010 Merrifield
2013/0263548 A1 * 10/2013 Merrifield ..... E04C 3/02 52/646
2015/0101261 A1 * 4/2015 Merrifield ..... E04C 3/005 52/67
2016/0090741 A1 * 3/2016 Jobin ..... E04C 3/005 52/646

FOREIGN PATENT DOCUMENTS

| | | |
|---|---|---|
| EP | 0 905 333 | 3/1999 |
| FR | 2898374 | 9/2014 |
| GB | 1 576 479 | 10/1980 |
| JP | S53-2159 | 1/1978 |
| JP | S532159 | 1/1978 |
| JP | S5443500 | 3/1979 |
| JP | H110192092 | 7/1998 |
| JP | H11117558 | 1/1999 |
| JP | 2870688 | 3/1999 |
| WO | 1999/06654 | 2/1999 |
| WO | 2013/086422 | 6/2013 |

OTHER PUBLICATIONS

Written Opinion, PCT/NO2014/050206, dated Jan. 30, 2015.
Written Opinion, PCT/NO2014/050206, dated Sep. 18, 2015.
European Search Report, EP Patent Application No. 14857135.9, dated Jul. 17, 2017.

* cited by examiner 400
401
402
403
403'
401'
404
100
101
102
103'
103''
104
116
117

SUPPORT STRUCTURE MODULE AND MODULAR BEAM STRUCTURE

CROSS REFERENCE TO RELATED APPLICATIONS

This application is the U.S. national stage application of International Application No. PCT/NO2014/050206, filed Oct. 30, 2014, which international application was published on May 7, 2015, as International Publication No. WO 2015/065200 in the English language. The international application is incorporated hereby by reference, in entirety. The international application claims priority to Norwegian Patent Application No. 20131460, filed Nov. 4, 2013, which is incorporated herein by reference, in entirety.

FIELD

The present disclosure relates to a collapsible, elongate support structure module, wherein the module is configured to form a beam or part of a modular beam structure, the module having an uppermost side element comprising a first element part and a second element part which between extreme ends of said uppermost side element are hinge connected to each other via a hinge connection, the two element parts being located in a common plane when the module is completely unfolded and stretched out, wherein the module has a) first and second upright, rigid module end elements, and b) in addition to said uppermost located side element at least two further side elements, and wherein said uppermost side element and said at least two further side elements extend between said module end elements and form mutual angle with each other, each module side element in longitudinal direction having a first extreme end and second extreme end which are hinge connected to said first and second module end elements, respectively, and each of said at least two further side elements being constituted by a first element part and a second element part which midway between said extreme ends are hinge connected to each other via a respective hinge connection to enable rotation of said first and second element parts toward or away from one another, the two element parts of each of these further side elements being located in a common plane when the module is completely unfolded and stretched-out.

BRIEF DESCRIPTION OF PRIOR ART

It is previously known collapsible, elongate structure modules intended for use as load supporting column which is exposed to vertical loading. Norwegian Patent 322174 describes such a solution.

Use of collapsible, elongate structure modules in modular beam structures presents, relative to use of such modules in columns, substantial challenges as regards tensional and compressive forces, and torsional forces about the longitudinal direction of the beam. The solution as shown in Norwegian Patent 322174 is not directly applicable as a lying beam structure.

To further elucidate prior art, it is referred to JP S532159 A, GB 1576479 A, JP 2,870,688-B, US 2010/0269446-A1, WO 2013/086422-A1, US 2006/0107611-A1, EP 0288323-B1 and U.S. Pat. No. 4,587,777. More general background prior art is found in WO 1999/06654 A1, EP0144471 A1, FR 2898374 A1, JP H10192092 A, U.S. Pat. No. 4,026,221 A, JP H1117558 A and JP S5443500 U.

SUMMARY

According to the present disclosure said module mentioned in the introduction is characterized in that any adjacent side elements of other two side elements abut each other and make co-operating engagement along one or a plurality of locations thereof, and that a releasable locking device is provided at said one location or at least at one of said plurality of locations to interlock adjacent edges of said at least two adjacent side elements of said side elements.

A variant of the first mentioned support structure module is in a beam structure intended to serve as a transition module to change the longitudinal direction of the structure, and this module variant is, according to the invention, wherein:

the uppermost located side element of the module has opposite edges of its two element parts configured at said hinge connection with co-operating male and female members said hinge connection being configured as a dead centre mechanism, characterized in that two side element parts of the uppermost located side element each having approximately shape of a truncated wedge face, and that the at least two further side elements of the module have different lengths in unfolding direction of the module, and wherein the module end elements constitute a mutual angle which is selectable in the range 5°-45°.

Said beam structure mentioned in the introduction is, according to the invention, characterized in that in successive pairs of the modules a second upright, rigid module end element on one module is attachable to a first, upright, rigid module end element on a neighbouring, next module of the structure by use of a male-female connection and/or bolt connection to make co-operating engagement along one or a plurality of locations of the structure, and that said releasable locking device is provided in any used module of the structure to interlock adjacent edges of said at least two adjacent side elements of said side elements of said any used module.

BRIEF DESCRIPTION OF THE DRAWINGS

The invention is now to be further described with reference to the attached drawings which exhibit preferred examples of embodiments which are non-limiting to the invention.

DETAILED DESCRIPTION OF THE DRAWINGS

Figure 1:
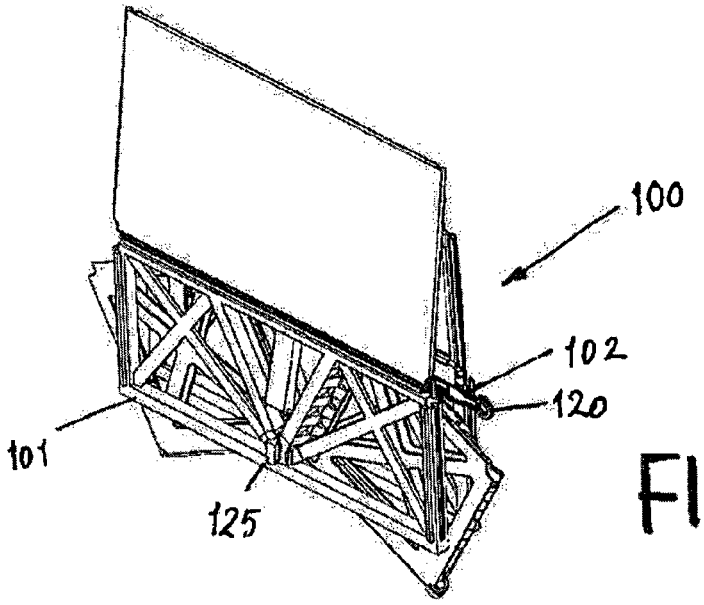
FIG. 1 shows in perspective view and from above a structure module, according to the invention, in a folded state.
Figure 2:
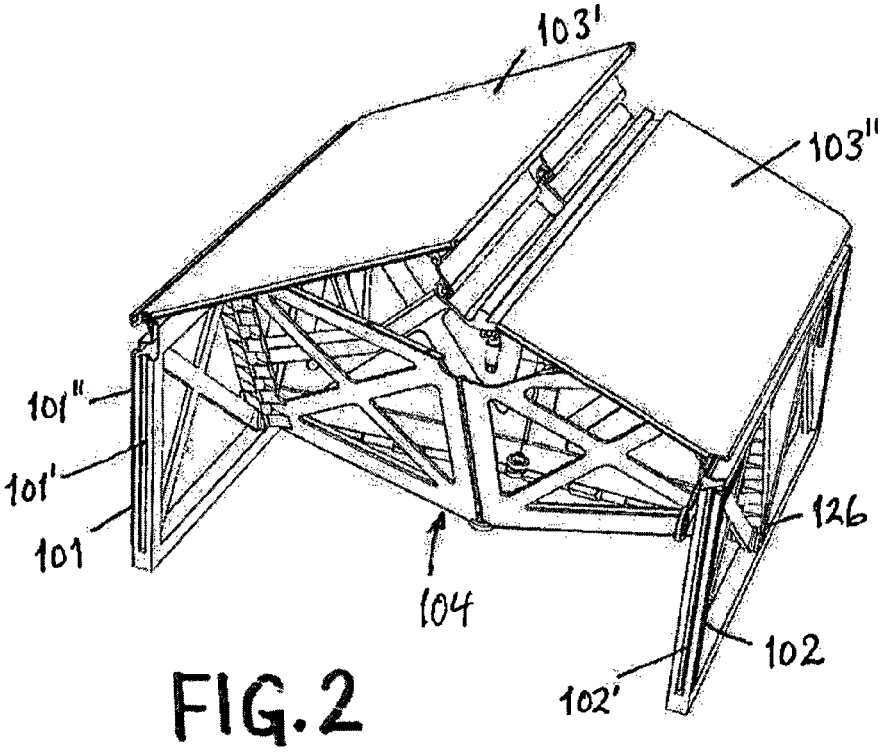
FIG. 2 shows the structure module in a perspective view from above, from a first side and in partly unfolded state.
Figure 3:
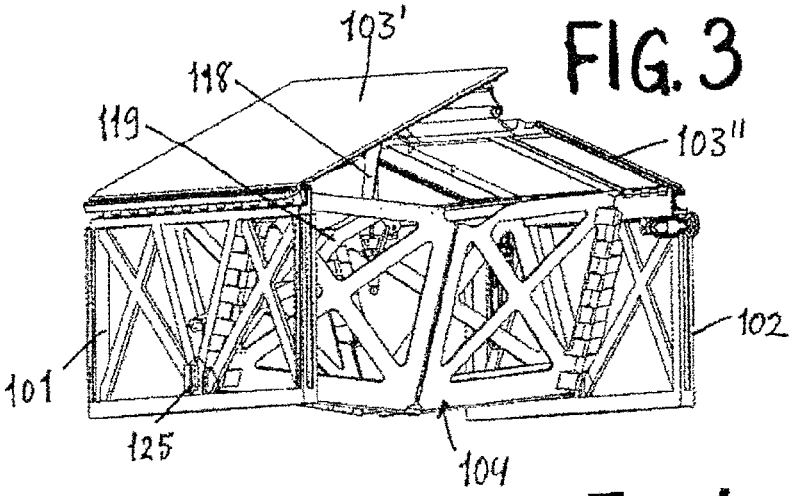
FIG. 3 shows the structure module in perspective view from a first end and said first side, and in partly unfolded state.
Figure 4:
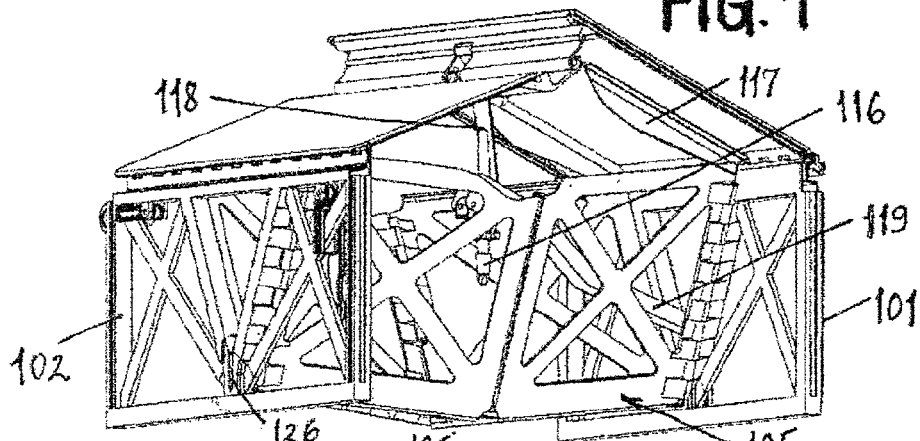
FIG. 4 shows the structure module in perspective view from a second, opposite end and a second side, and in partly unfolded state.
Figure 5:
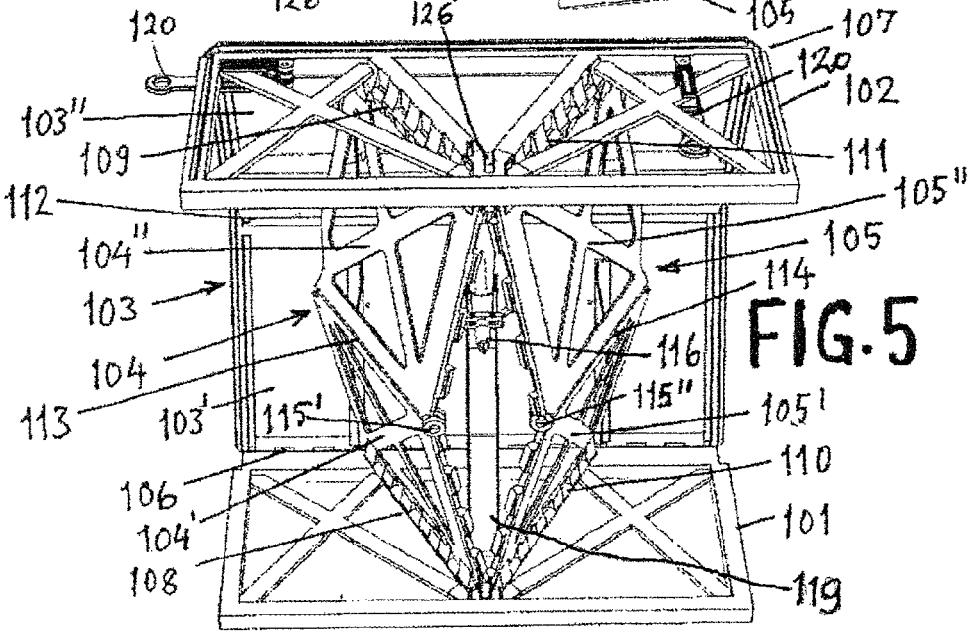
FIG. 5 shows the structure module in perspective view from below, from said second end and in partly unfolded state.
Figure 6:
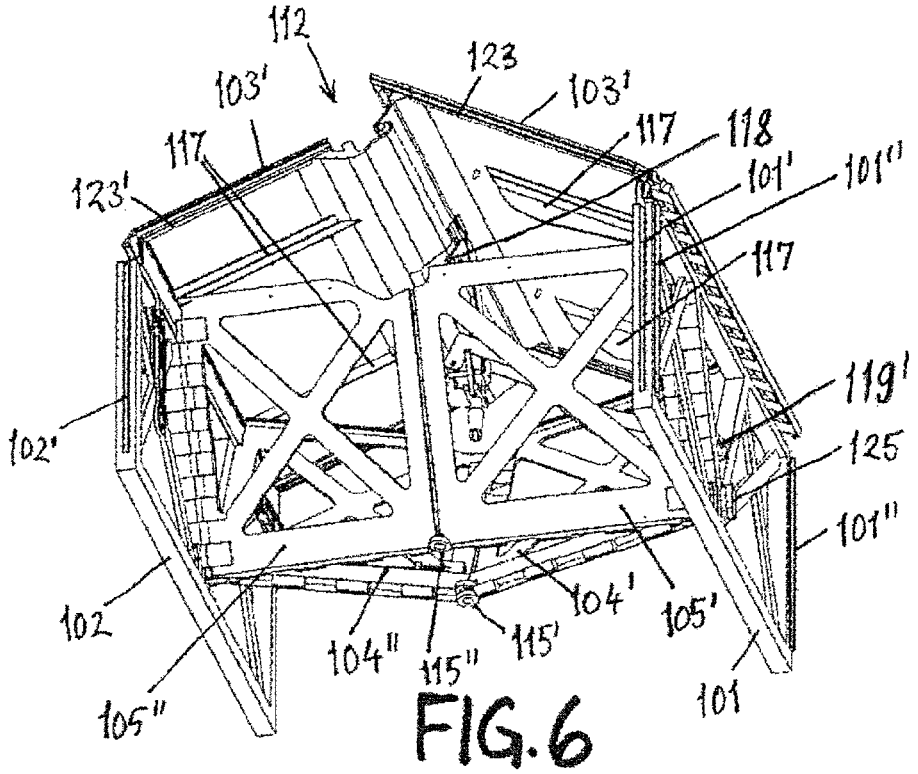
FIG. 6 shows the structure module in perspective view from below, from said second side thereof, and in partly unfolded state.
Figure 7:
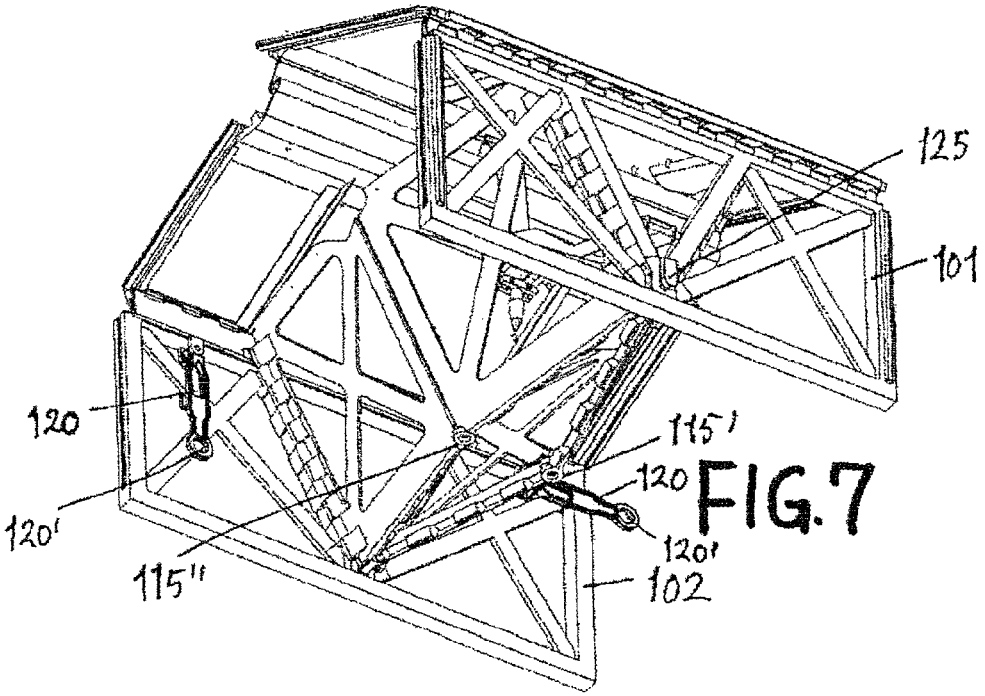
FIG. 7 shows the structure module in perspective view from below, from the first end thereof and the second side, and in partly unfolded state.

FIGS. 1-14 show a collapsible, elongate support structure module 100, the module being configured to constitute a beam or part of a modular beam structure, as shown on FIGS. 24-35.

The module has first and second upright, rigid module end elements 101 and 102. The module has in addition at least three side elements 103, 104 and 105 which extend between said module end elements 101, 102 and make mutual angle with each other.

In the description to follow and in the claims the module elements 101 and 102 are indicated as being upright. This implies that they may also have an orientation other than being vertical if the beam or beam structure to be formed is not horizontal. In the description to follow and in the claims there is described the use of at least three side elements 103, 104, 105, and the side element 103 is described as an uppermost side element which thereby appears as a foldable and lockable top element. The side element 103 will in use usually have a lying posture, although not necessarily horizontal posture, as the beam or beam structure can be sloping, be inclined or for certain use, be horizontal. In addition to the uppermost side element, there is additionally at least two further side elements, i.e. the side elements 104 and 105. These side elements 104 and 105 are also foldable and preferably lockable, and will act as supportive elements. The module elements 101 and 102, together with the side elements 103, 104 and 105 jointly constitute co-operating structure elements in a module 100 which is included in a beam or beam structure, as will clearly appear from the detailed description and the drawings.

Each side element 103; 104; 105 has in longitudinal direction a first extreme end 106; 108; 110 and second extreme end 107; 109; 111, respectively, being hinge connected to said first and second module elements 101, 102, respectively.

Each side element 103; 104; 105 is formed by a first element part 103'; 104'; 105' and a second element part 103"; 104"; 105" which at a location 112; 113; 114 midway between said extreme ends 106; 108; 110 and 107; 109; 111, are hinge connected to each other to enable the respective first and second element parts to be pivoted toward and away from one another, as shown on drawing FIGS. 1-14, the two element parts 103'; 104'; 105' and 103"; 104"; 105" of each side element 103; 104; 105 being located in a common plane when the module is fully unfolded and stretched-out.

Figure 14:
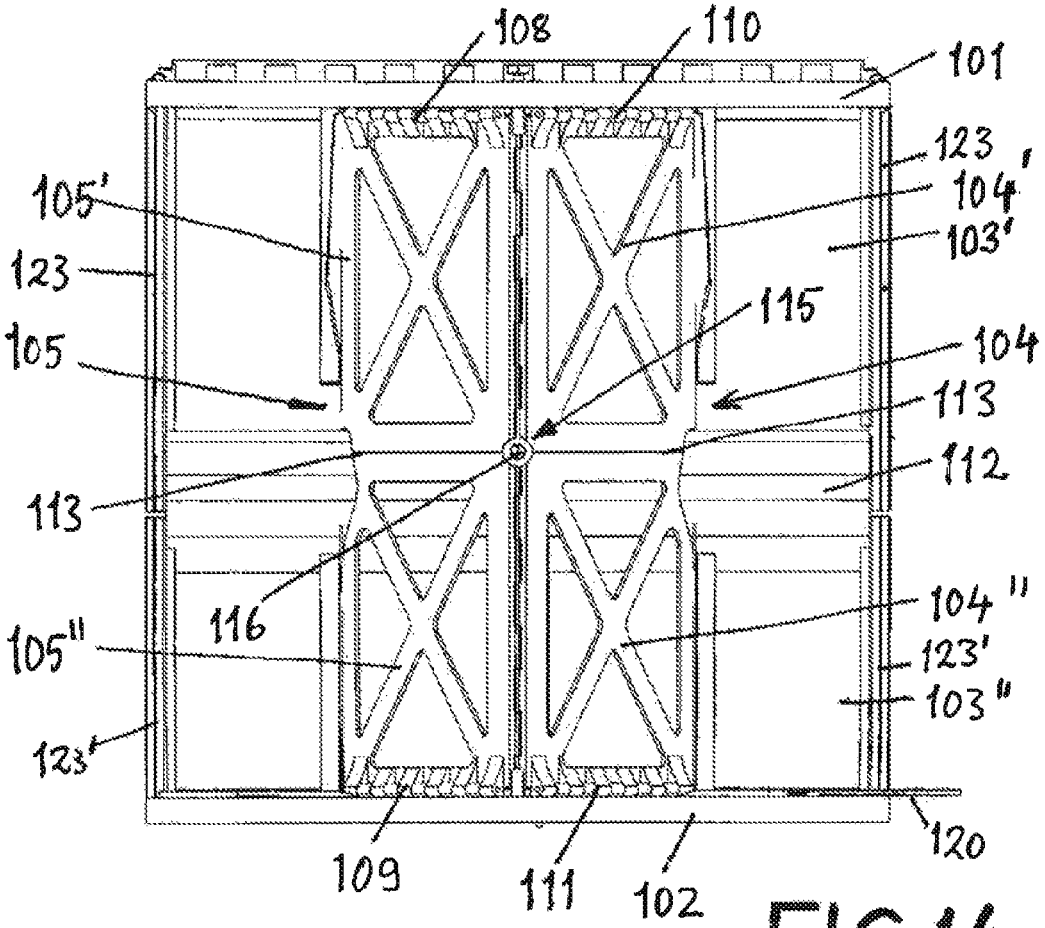
FIG. 14 shows the structure module in plan view from below, and in completely unfolded state.
Figure 15:
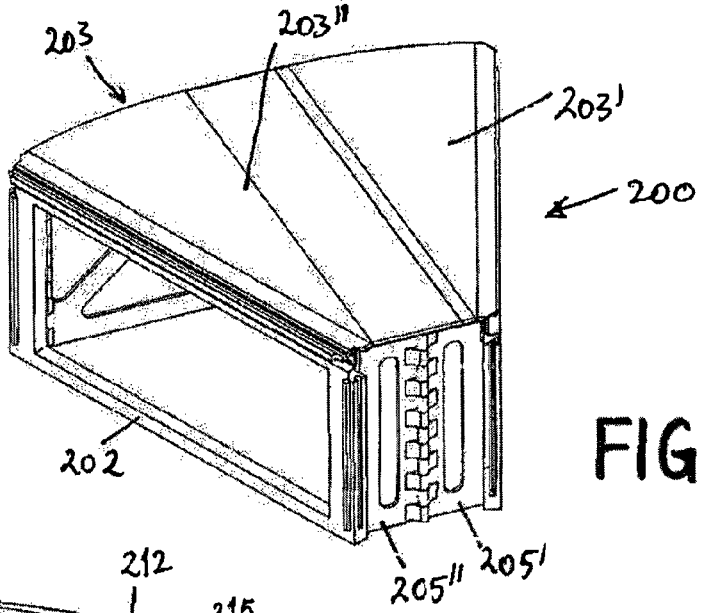
FIG. 15 shows a modified structure module in perspective view from above, from a first end and a first side thereof, and completely unfolded, configured as a transition module which is intended to change the direction of a beam structure.
Figure 16:
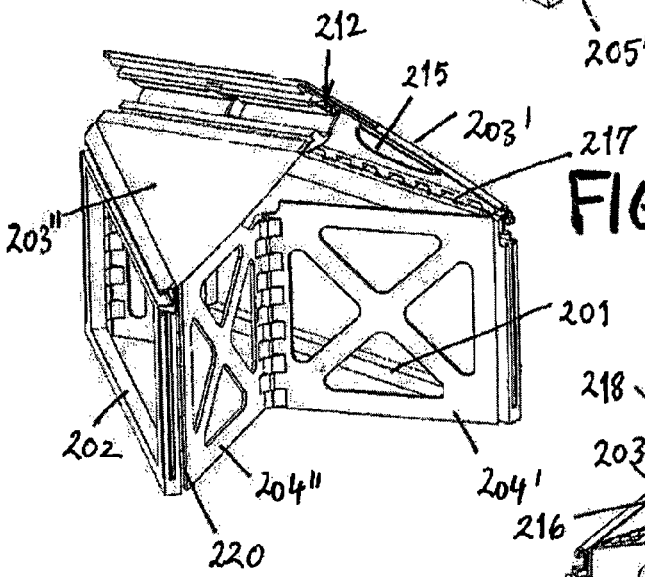
FIG. 16 shows the transition module in perspective view from above, from a second end and a second side, and in partly unfolded state.
Figure 17:
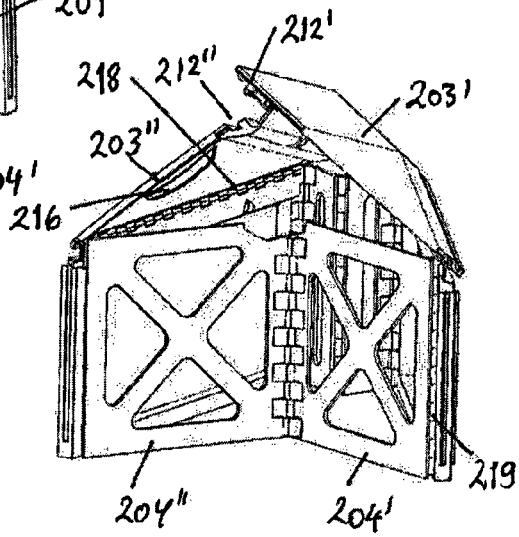
FIG. 17 shows the transition module in perspective view from above, from the second end, and in partly unfolded state.
Figure 18:
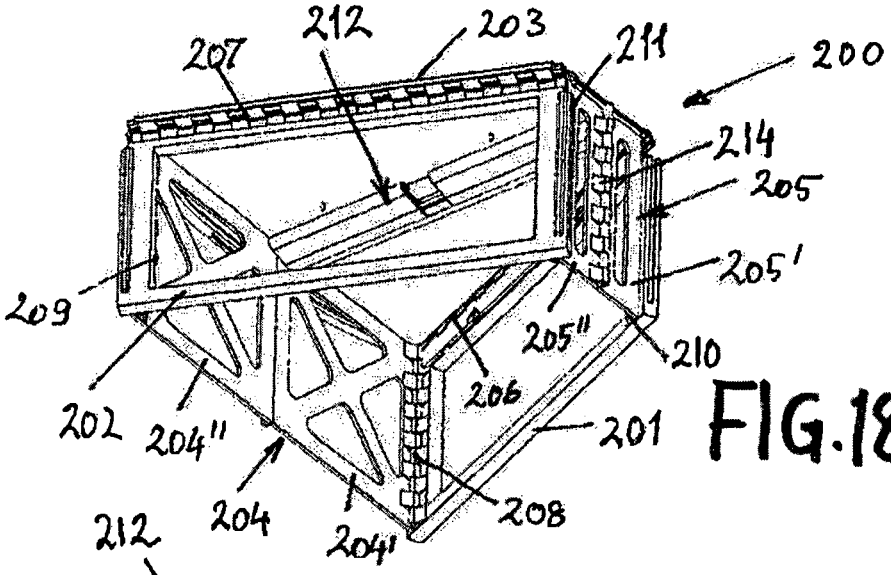
FIG. 18 shows the transition module in perspective view from below and from the first end and the first side thereof, and in completely unfolded state.
Figure 19:
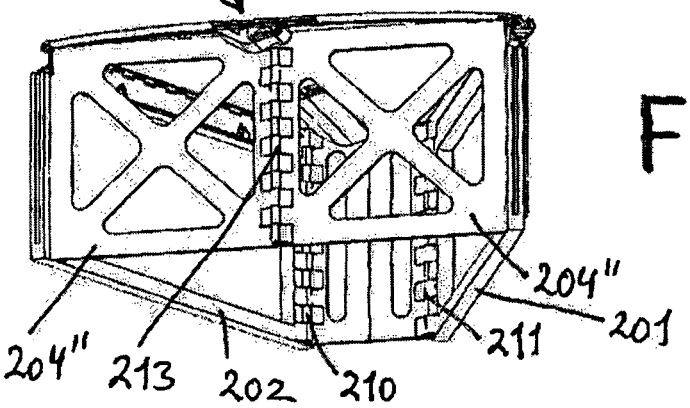
FIG. 19 shows the transition module in perspective view from below and from the second side thereof.
Figure 20:
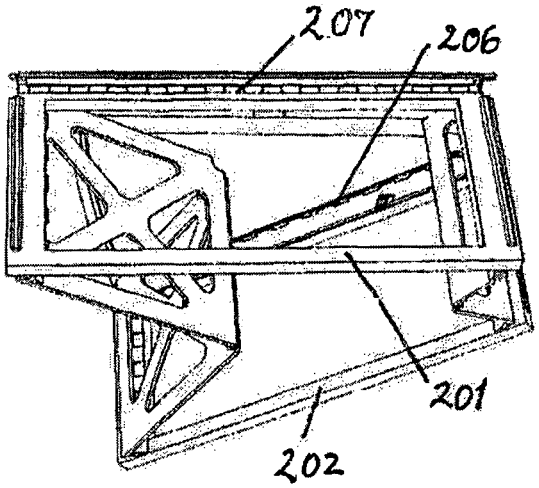
FIG. 20 shows the transition module in perspective view from below and from the first end, and in partly unfolded state.

As will appear from FIG. 14, adjacent edges of the side elements 104; 105 abut or form co-active engagement along one or more locations 115 thereof. The location 115 will serve for engagement with a releasable locking device, preferably configured as a locking peg 116 at said one or more locations 115 to interlock adjacent edges of said at least two adjacent side elements 104; 105.

Figure 12:
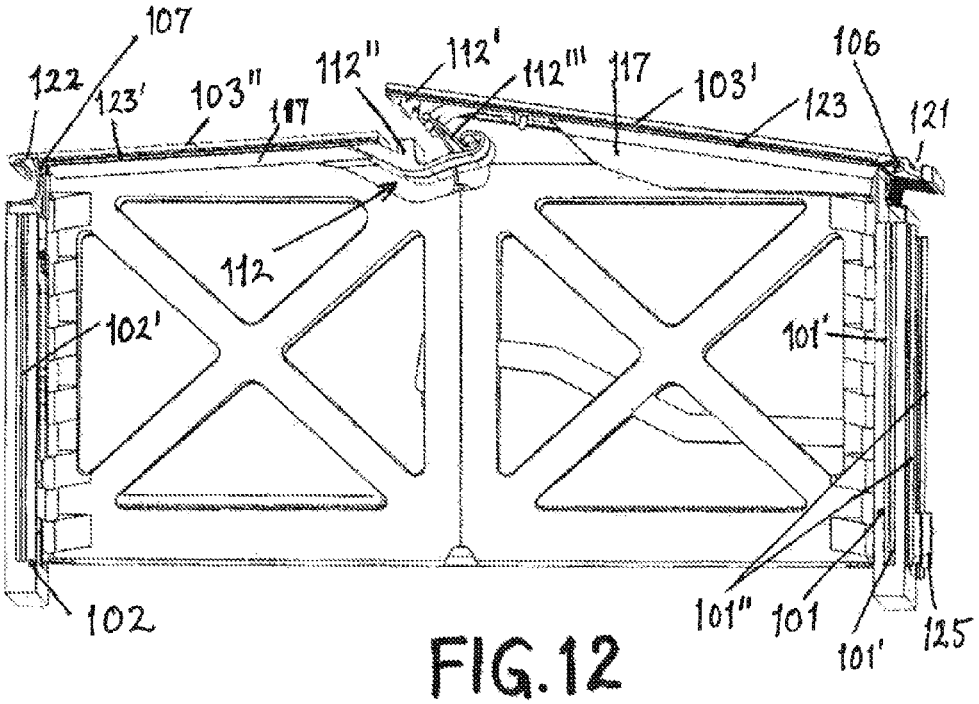
FIG. 12 shows the structure module in slight perspective view from below and from said first side, and in approximately completely unfolded state.
Figure 13:
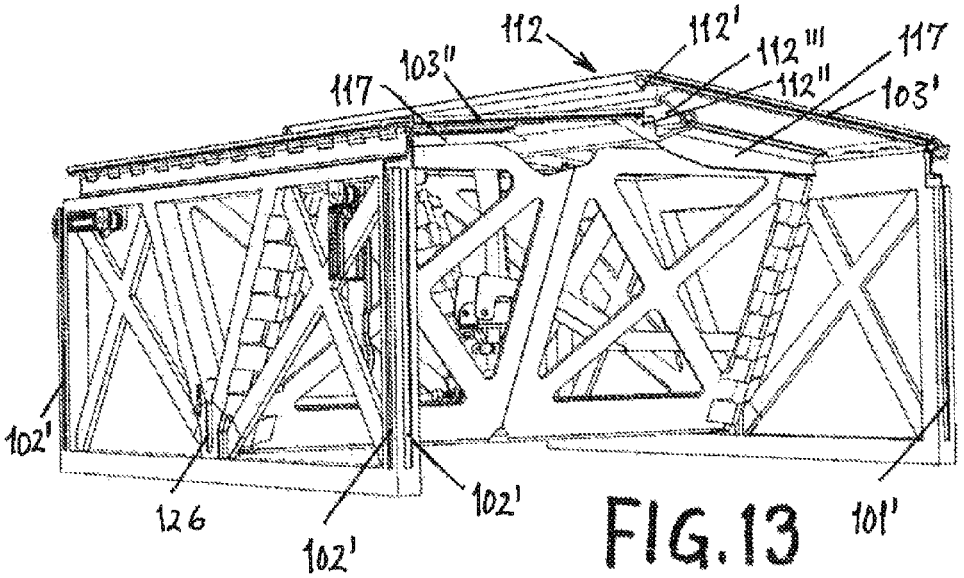
FIG. 13 shows the structure module in perspective view from the second end and the second side, and in approximately completely unfolded state.
Figure 27:
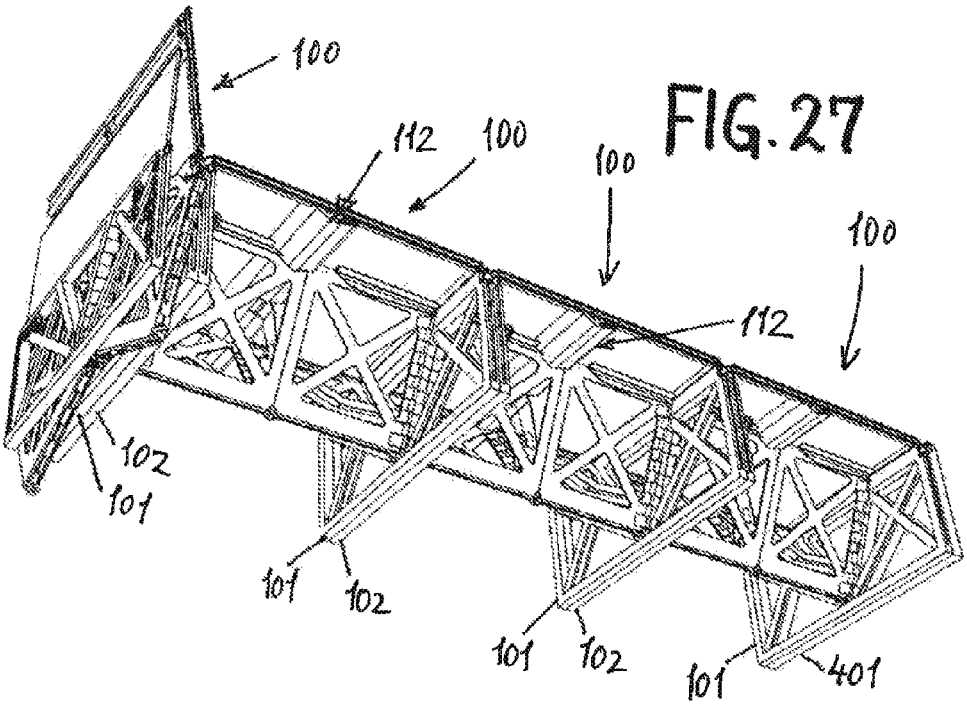
FIG. 27 shows the beam structure in perspective view from below, from said one side and from an end which is ready to be expanded.
Figure 28:
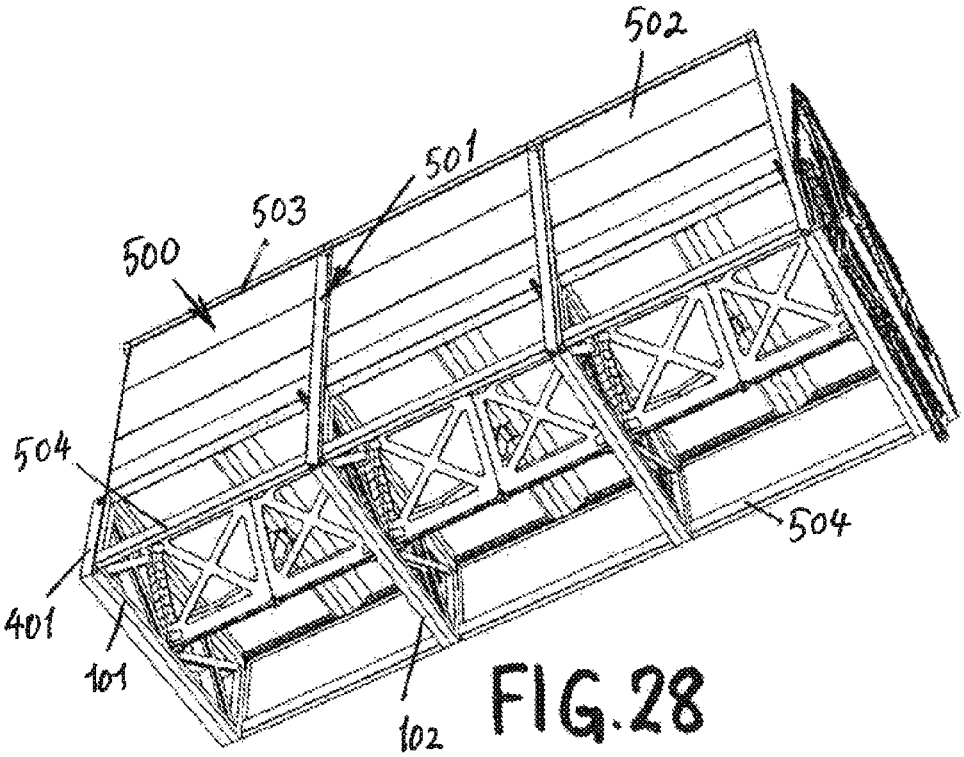
FIG. 28 shows the beam structure in perspective view from below, from said second side, from an end which is ready to be expanded, and with an end connected to a support frame for attachment to an attachment device, e.g. a wall or a securing block, the structure being provided footpath walls.
Figure 29:
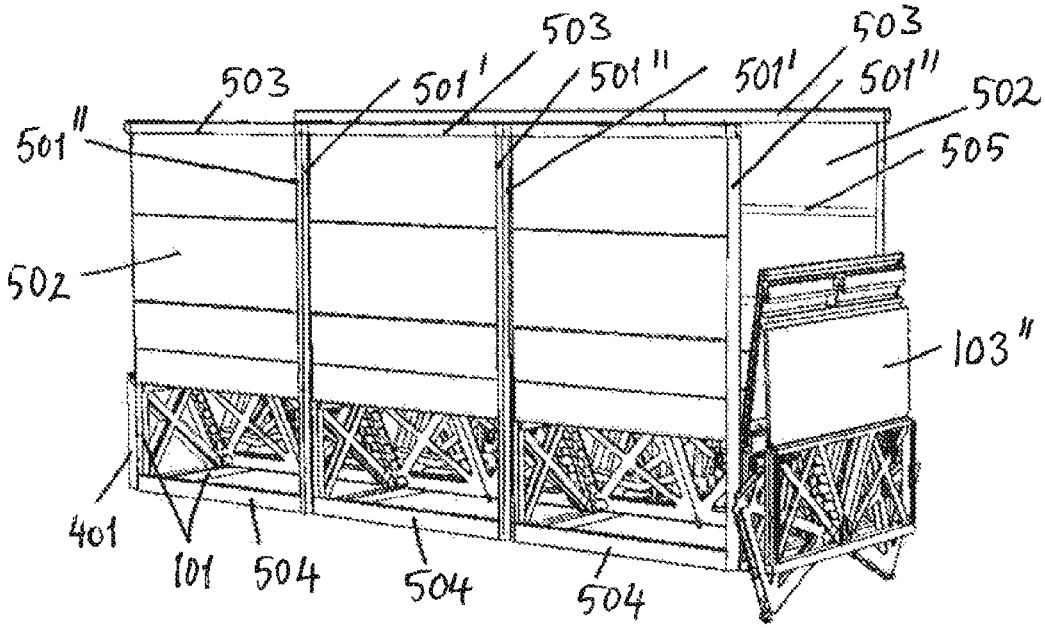
FIG. 29 shows the beam structure on FIG. 28 in perspective view from said second side and an end which is ready to be expanded.
Figure 30:
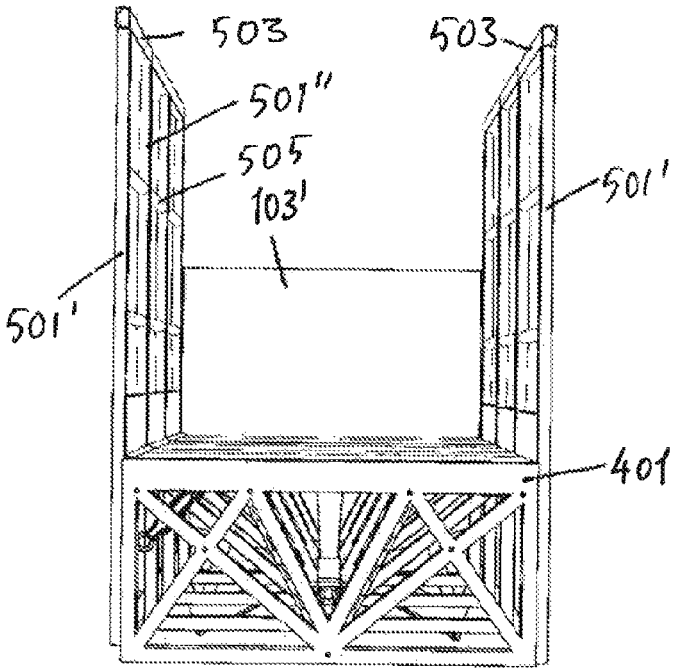
FIG. 30 shows the beam structure on FIG. 28 viewed in isometric perspective view from an end having support frame installed thereon.
Figure 31:
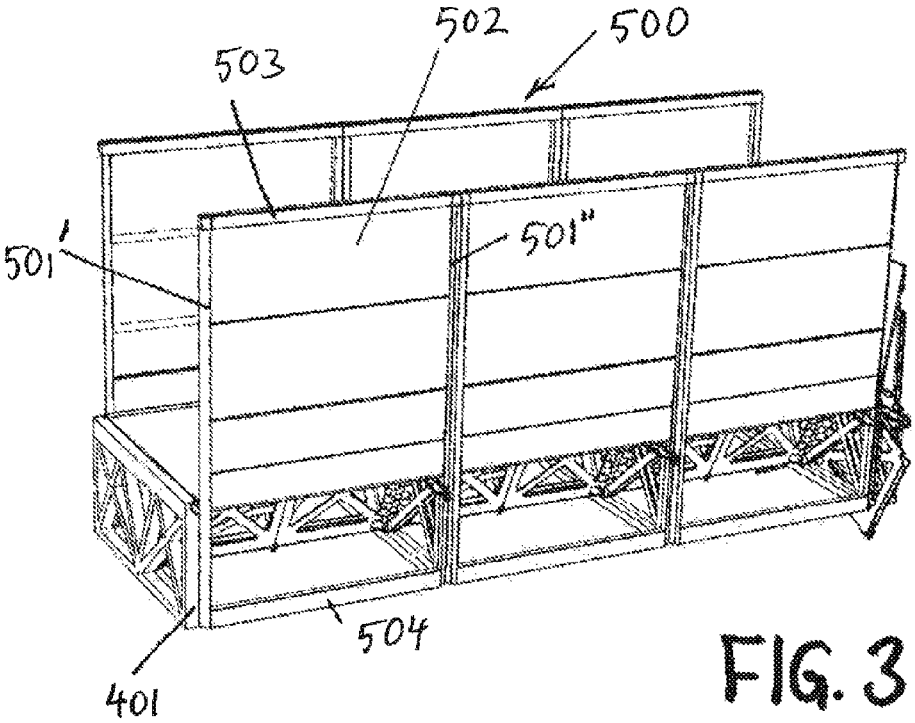
FIG. 31 shows the beam structure on FIG. 28 in perspective view from above, from said second side and from an end which is attached to the support frame.
Figure 32:
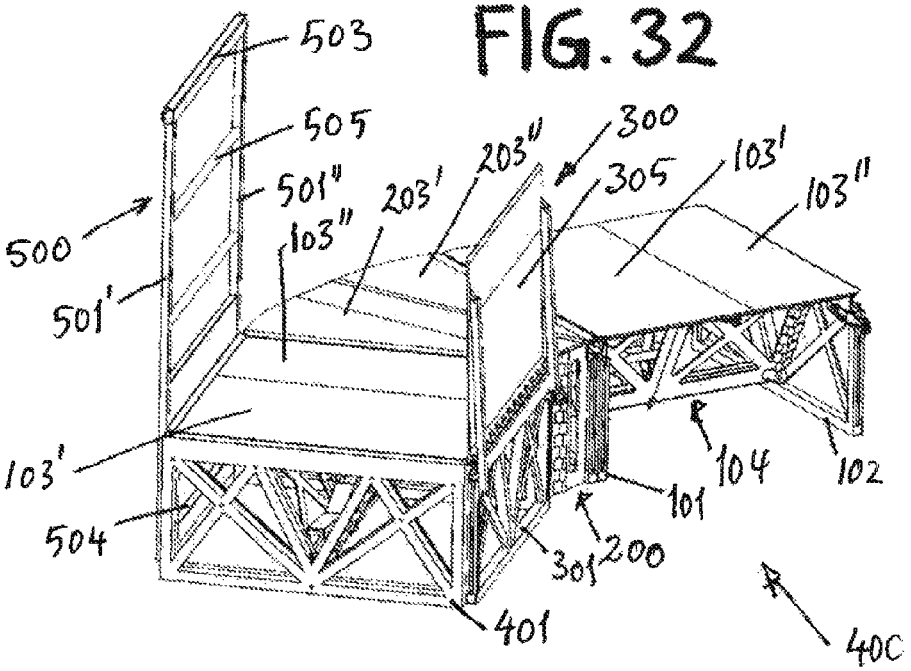
FIG. 32 shows a modular, modified beam structure in perspective view from above and from one end intended for fixed installation onto an anchoring device, e.g. a wall, where a module has installed thereon a wall and a platform, and where there is included a transition module for changing the structure in longitudinal direction.
Figure 33:
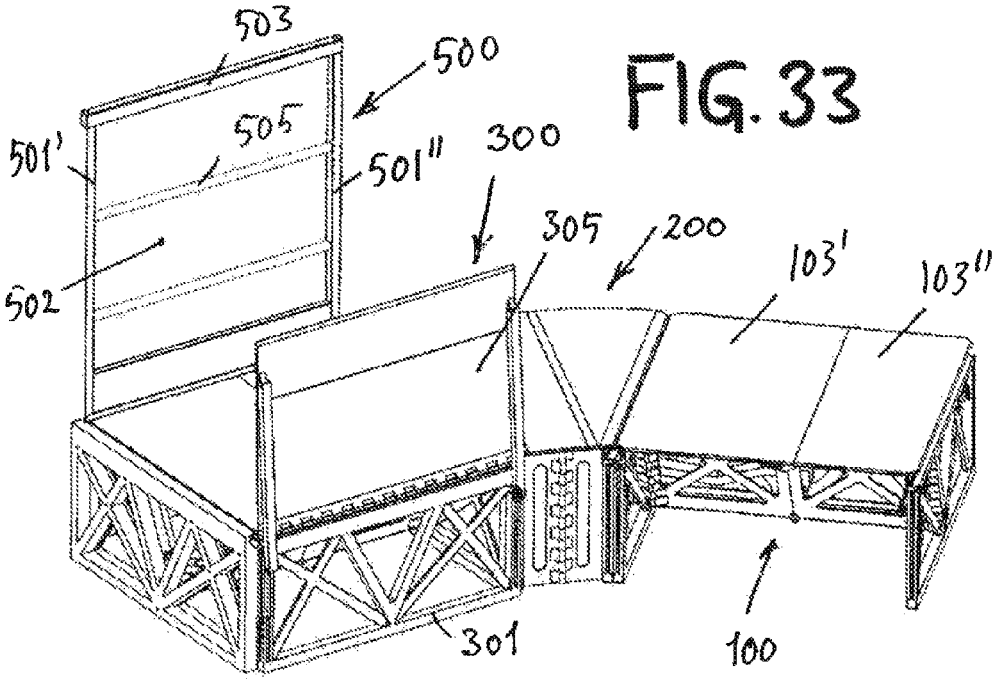
FIG. 33 shows the beam structure in perspective view from above and from the second side.
Figure 34:
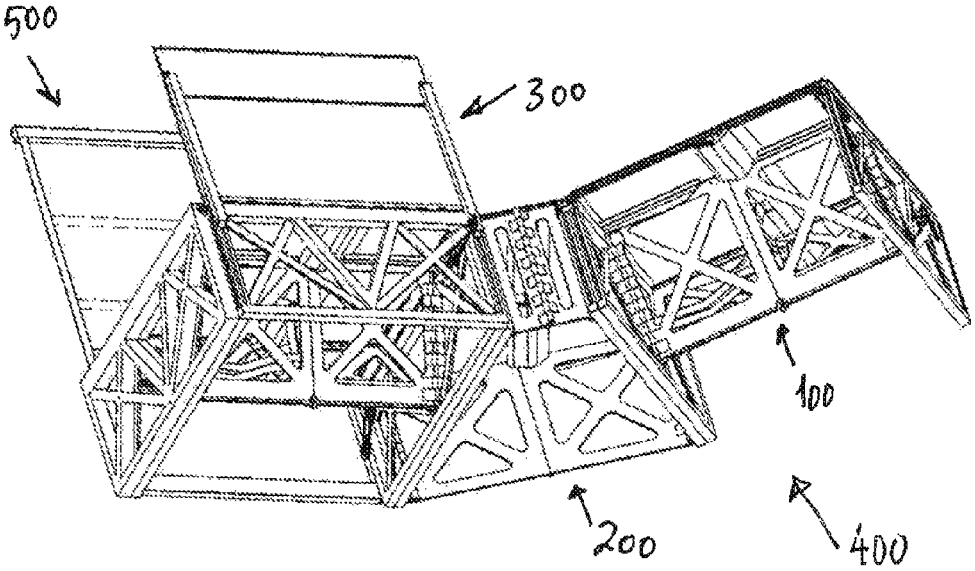
FIG. 34 shows the beam structure in perspective view from below and from the second side.
Figure 35:
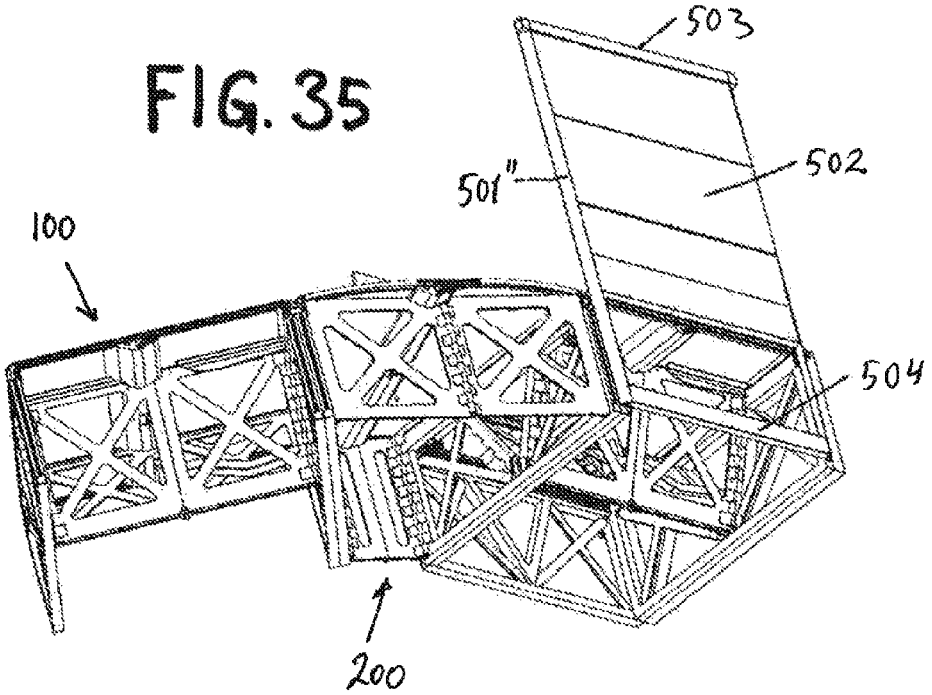
FIG. 35 shows the beam structure in perspective view from below and from the first side.

From FIGS. 12 and 13, and from e.g. FIGS. 27, 32 and 33 it will appear that the uppermost one 103 of said at least three side elements 103-105 with its extreme ends 106 and 107 makes hinge connection to a respective end element 101; 102 and has an upper surface level with an upper edge face of said respective end element 101; 102. Correspondingly, the side elements 104 and 105 have said extreme ends 108, 109 and 110, 111 which form respective hinge connection with the module end elements 101, 102.

The module end elements 101; 102 are on upright side faces in the unfolding direction of the module and transversely of the unfolding direction provided with engagement elements 101'; 101"; 102' configured for engagement with co-acting engagement elements on:

a) a corresponding module 100 which is arranged to extend in longitudinal direction of a beam structure or laterally, transverse of longitudinal direction of the structure, or
b) a transition module 200 which is insertable into a beam structure 400 and configured to change direction of length extent of the structure 400, or
c) a platform 300 which is configured to extend out from one end of the beam structure 400 or transverse of longitudinal direction of the structure, or
d) posts for railing or fence 500 for placing along one or more modules in longitudinal direction of the beam structure.

The uppermost located side element 103 of the module 100 has said midway located hinge connection 112 preferably configured as a dead centre mechanism, and where the opposite edges of the side elements 103'; 103" at the hinge connection are configured with co-operative male and female members 112'; 112".

It will be observed that the hinge connection 112 has a hinge leaf 112'" which is mounted in an extension of the part 103" and to an underside of the part 103', respectively. It will be appreciated that when these male/female members 112'; 112" engage, they will strengthen the hinge connection 112 and prevent the parts 103'; 103" to move apart when a beam structure 400 in which the module 100 is included, is bent downwards.

In the shown solution there is created a "dead centre mechanism" and force will be required, e.g. from a tool, to pass the hinge over the dead centre for possible folding together of the module. This is due to that a first pivot point 124 on the hinge (see FIG. 10), when the parts 103' and 103" are in the same plane, will be located closer to the underside of the part 103' than the distance of the second pivot point 124' of the hinge 112 from the underside of the part 103'.

There is on the underside of the two parts 103'; 103" associated with the uppermost located side element 103 arranged downward protruding engagement pieces 117 configured for engagement with at least one side face portion of respective adjacent part 104'; 104" and 105'; 105" of adjacent lower side element 104; 105, located on the underside of the uppermost located side element 103. This engagement will cause that upper portion of the side elements 104; 105 is not bent laterally outwards when exposed to loading or downward bending of a support beam structure 400.

The releasable locking device is, as mentioned, preferably configured as a locking peg 116. As shown on e.g. FIGS. 3, 4, 6, 7, 10 and 13 it is articulated via a link 118 with said midway hinge connection 112 between uppermost located side element parts 103'; 103" and with one of the module end elements 101 via a link 119. The link 119 is pivotally linked to the module end element 100 at a location 119' as indicated in FIG. 11.

The locking peg 116 is configured for co-operative engagement with respective locking ear 115'; 115" arranged at a lower edge on the midway located hinge connection 113; 114 between the hinged parts 104', 104"; 105'; 105" of the two lower side elements 104; 105, respectively. Simultaneously with the parts 103'; 103" at their opposite ends being brought into engagement with each other, the lower edges of the side elements 104; 105 are brought into engagement and contact with each other, yielding that the locking ears 115'; 115" are lying one above the other and being coaxial, whereby the locking peg 116 can enter into controlled engagement with these locking ears, to prevent mutual movement of the side elements 104; 105 during loading of a beam structure 400 in which the module is present. The simultaneous engagement of the side elements 104; 105 with the engagement pieces 117 contribute to structural stability of the module 100 in stretched-out, locked state.

The locking peg 116 will thus yield that the module 100 cannot collapse as long as it is in engagement with the ears 115', 115". The peg 116 does not enter into engagement with the ears 115', 115" without the side elements 104, 105 being in contact with each other at lower edges thereof, and that the upper side element 103 simultaneously assumes a completely flat, single-plane posture. The advantage this locking methodology is that there is not required any particular tool in order to carry out the locking. The links 118, 119 safeguards that the locking peg does not move out of its position.

It will be seen from FIGS. 1-14 that a cross-section of the side elements assembly consisting of the side elements 103-105 or a cross-section of an area of a side element 103 together with remaining side elements 104; 105 of the side elements assembly in fully stretched-out state of the module 100 has a polygonal shape which in the shown embodiment is triangular, but may be squared or rectangular, dependent on number of used side elements. Currently, a preferred embodiment consist of three side elements 103; 104; 105.

When it is desired to build a beam structure using interconnected modules 100 there may arise need for one or more changes in direction of the extent of the beam in longitudinal direction. For this purpose it is proposed to provide a transition module 200, configured as a collapsible, elongate support structure module as show on FIGS. 15-20, the module proper capable of forming a beam, but in the discussion of the beam structure 400 shown on FIGS. 32 and 33 forming part of a modular beam structure.

The transition module 200 has first and second upright, rigid module end elements 201; 202, and at least three side elements 203; 204; 205 which extend between said module end elements and form mutual angle with each other. Each side element 203; 204; 205 has in longitudinal direction a first extreme end 206; 208; 210 and a second extreme end 207; 209; 211 being hinge connected thereat to said first and second module end elements 201; 202, respectively. Each side element 203; 204; 205 is constituted by a first element part 203'; 204'; 205' and a second element part 203"; 204"; 205" which at a respective location midway between said extreme ends 206; 208; 210 and 207; 209; 211 are hinge connected to each other and thereat form a respective hinge connection 212; 213; 214 to enable the first and second element parts to be pivoted toward or away from one another, as shown on FIGS. 15-20, the two element parts 203', 203"; 204', 204"; and 205', 205" of each side element 203; 204; 205 being located in a respective common plane when the module is completely unfolded and stretched-out.

In the description to follow and in the claims the module elements 201 and 202 are indicated as being upright. This implies that they also may exhibit a different orientation than being vertical if the beam or beam structure to be formed is not horizontal. In the description to follow and in the claims, the side element 203 is recited as an uppermost side element of the at least three side elements 203, 204 and 205. The side element 203 thereby appears as a top element. As will be described, it is foldable and lockable. The side element 203 will usually have a lying posture when used, although not necessarily horizontal posture, as the beam or the beam structure in which the transition module 200 is included can be sloping, be inclined or, for certain use, be horizontal. In addition to the uppermost side element there are at least two further side elements, i.e. the side elements 204 and 205. These side elements 204 and 205 are also foldable and preferably lockable, and will function as supportive elements. The module elements 201 and 202, together with the side elements 203, 204 and 205 jointly constitute co-operating structure elements of the module 200 which is included in a beam or beam structure, as will clearly appear from the detailed description and drawings.

The uppermost located side element 203 of the module has said midway located hinge connection 212 preferably configured as a dead centre mechanism, wherein opposite edges of the parts at the hinge connection are configured with co-operable male and female members 212'; 212", and wherein the two side element parts 203'; 203" have approximately truncated wedge face shape.

If the hinge connection 212 is configured as a dead centre mechanism, it may preferably be of same type as shown and described for the module 100. In order to prevent that the transition module 200 unintentionally becomes unlocked, it is similar to that for the module 100 possible on the underside of the parts 203' and 203" to arrange respective engagement pieces or studs 215 (see FIG. 16) and 216 (see FIG. 17) which prevent the side elements 204 and 205 from turning inwards when the side element 203 with its parts 203', 203" is in a flat, closed posture as shown on FIG. 15.

In order to obtain intended angled transition, i.e. a change of direction of the beam structure 400, then the other two side elements 204; 205 must have unequal lengths in the unfolding direction of the module 200. Dependent on the mutual length dimension of the side elements, the module end elements 201; 202 may thereby be able to form a mutual angle which is e.g. electable in the range 5°-45°.

This possible angular range is not in any way to be conceived as limiting to aspects of the transition module 200, as the range can be smaller or larger, or have another lower and/or upper angle value.

The modules 100 and 200 have in the shown embodiment module end elements which each have a rectangular or squared configuration. It is also possible to imagine that they could have triangular configuration, but that may complicate solutions in which a beam structure has a need for laterally extending elements. Rectangular or squared configuration are the currently preferred solutions.

By using the shown module solutions, there is obtained structurally torsion stable and strong modules. When exposed to heavy loads or where a modular beam has substantial length, i.e. consisting of a plurality of interconnected modules, it may be required to provide for suspension points, and for this purpose each module can be provided with a pair of suspension brackets 120. This is in particular of interest if there is present a roof or the like (not shown) above the structure 400 where such suspension points (not shown) are possible to arrange or where it is possible between mounting locations to attach one or two wires or chains (not shown) which the brackets can be connected to via adjustable stays, wires or chains. The brackets 120 will normally hang downwards, but may upon demand be swung 90° so that they become horizontal and the bracket suspension ear 120' protrudes outside the side of the module. If there is a stable area below the structure, e.g. a floor, a stable terrain or the like, it will be possible to arrange supporting devices, e.g. posts, which engage a plurality of module end elements.

The module end elements 101; 102 have, as mentioned, on upright side faces in the unfolding direction of the engagement elements 101"; 102' and transverse of the unfolding direction, engagement elements 101'; 102' which are configured for engagement with co-operating engagement elements on adjacent module or a platform. More specifically, on the side faces which face in the unfolding direction, the engagement elements 101" preferably have a male wedge configuration, whereas the engagement elements 102' preferably have female wedge track configuration, and the engagement elements 101'; 102' on the side faces facing in the transverse direction of the module preferably have female wedge track configuration. In the case that some modules are to be easily releasable from each other, it may preferable to let the female wedge tracks 101'; 102' in the bottom have an abutment for a lower end of the elements 101", to avoid a materials setting which renders such releasing difficult. An alternative to this may possibly be to let the female wedge tracks have an anti-friction means added thereto, possibly in fluid form before joining with other modules. The engagement elements 101'; 101"; 102' can advantageously have dovetail shaped cross-section, although other cross-sections may be envisaged.

Although not shown on the drawings, it is of course possible to provide extra securing between interconnected modules by using bolt connections or setscrews.

Figure 10:
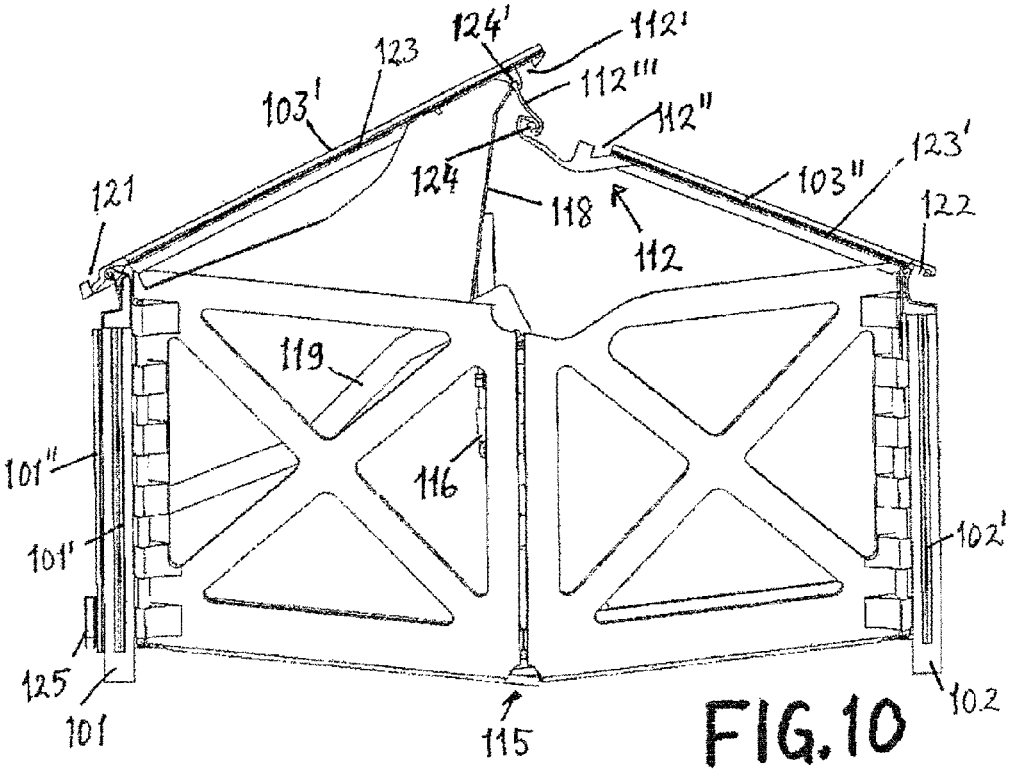
FIG. 10 shows the structure module viewed from the first side, and in partly unfolded state.
Figure 11:
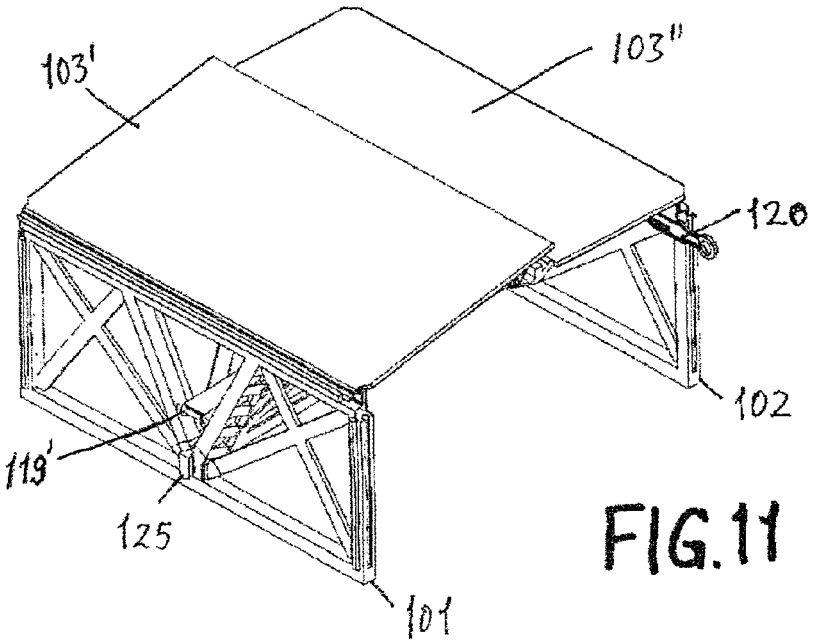
FIG. 11 shows the structure module in perspective view from above, from the first end and the first side, and in partly unfolded state.

On FIG. 10 it will be noted that the side element part 103' at the end which is closest to the module end element 101 has an upward facing hook shaped edge 121, and that the side element part 103" at the end which is closest to the module end element 102 has a downward facing hook shaped edge 122. This safeguards that when the parts 103' and 103" lie in the same plane, i.e. that the module 100 is fully stretched-out and locked, then these edges 121 and 122 engage each other. This engagement is essential for the rigidity of a beam structure 400, as the hook shaped edges 121, 122 thereon are used for engagement with a neighbouring edge 122 on an upstream located module and engagement with a neighbouring edge 121 on a downstream located module. By upstream and downstream is in this context or other places in the description conceived that upstream refers to module which is start module or module which is closer to the start module in the created beam structure, and correspondingly that downstream is related to a module which is present in the beam structure after the start module or after currently described module in the beam structure.

The longitudinal edges of the side elements 103' and 103" can on the underside of a module 100 in longitudinal direction of a beam structure 400 have downward facing hooks 123, 123' (see FIGS. 6, 10, 12 and 14) to create engagement with e.g. an edge 121 on another module which is to be installed laterally relative to longitudinal direction of the structure 400.

Figure 21:
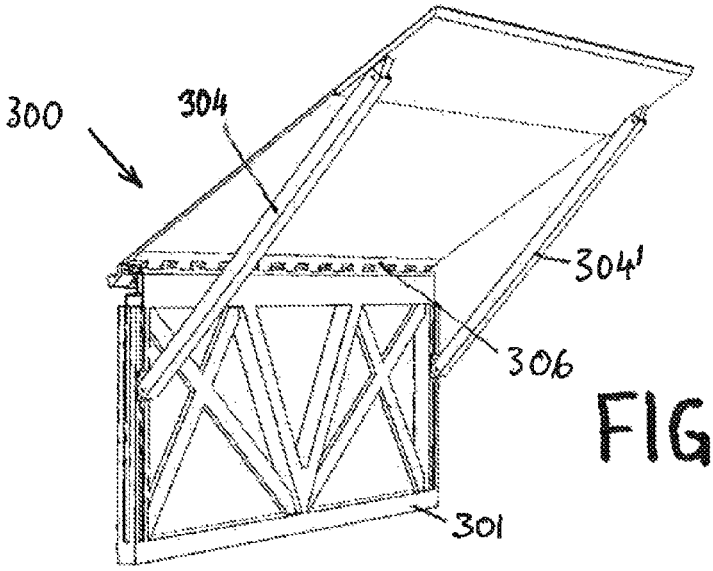
FIG. 21 shows in perspective view and partly unfolded state a platform which is hookable onto side portions of end elements of a module or onto a module end element of an unfolded module.
Figure 22:
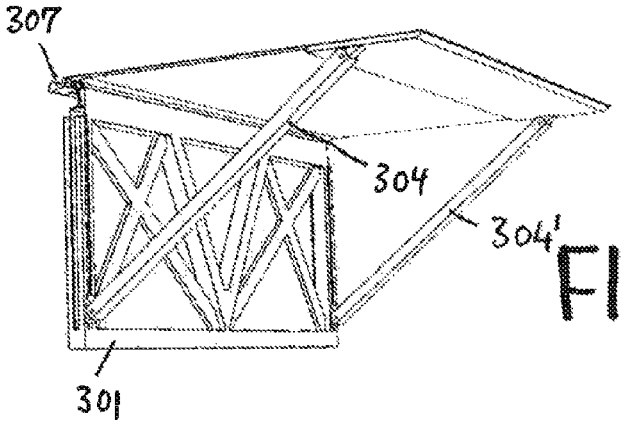
FIG. 22 shows the platform viewed in perspective from below and from one side thereof in completely unfolded state.
Figure 23:
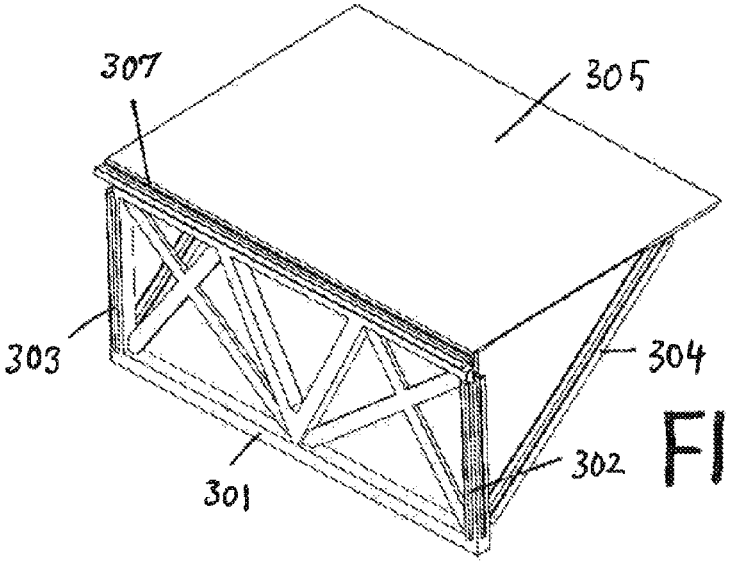
FIG. 23 shows the platform in perspective view from above and from said one side thereof in completely unfolded state.

A platform 300 which functions either as a side extender or an end extender associated with a specific module or in conjunction with a beam structure 400 is shown on FIGS. 21-23. Such a platform 300 may be useful where there is a demand for a larger surface of fuse at some locations along a structure 400, but where it will be unnecessary or impractical to attach a complete module. The platform has a start frame 301 which is compatible with configuration of a module, so that engagement elements 302, 303 having male-configuration can make engagement with female engagement elements 101', 102' on longitudinal side of a module, or female engagement elements 102', 102' on transverse end of a module 100. The platform has two inclined stays 304, 304' which support the platform floor 305. The floor 305 makes connection with the frame 301 via a hinge 306. The platform 300 can be tilted to an upright posture such that the stays and the floor stand parallel for easier displacement of the platform to a required location of installation, or from a location of installation and to another one when required. It will be observed that the edge of the floor 305 which is closest to the frame 301, and the hinge 306 have a configuration like an upward facing hook 307, in order that this hook will make engagement with the hooks 123, 123' when the floor is in plane with the module side element 103.

On FIGS. 1, 3, 6, 7, 10 and 11 there is shown an engagement peg 125 which is intended to make engagement with an engagement slot 126 as shown on FIGS. 4, 5, 9 and 13. Engagement between the peg 125 and the slot 126 safeguards that the module end elements 101, 102 which are interconnected, obtain an additional anchoring to each other in addition to the co-operation between the engagement elements 101"; 102'. In addition, it is also limited to a certain extent how far down the male engagement element 101" can extend down into the female engagement element 102'.

The modules 100 have normally a low weight and will thereby be light and simple to handle, in such a way that they can be installed by one person, possibly by two persons. Because the modules can efficiently be interconnected, in addition to having a framework configuration, there is thus obtained excellent structural rigidity, not only against downward bending forces, but also against torsional forces.

Each module can typically have, seen from above, a dimension equal to 1×1 meter, although neither quadratic configuration or dimensions must be conceived as a limitation for the use of the invention. Other configurations and dimensions are of course imaginable.

The hook shaped edges 121, 122 of the uppermost side element 103 engage into respective corresponding ends of uppermost adjacent side elements of modules 100, and these hook shaped edges 121, 122, together with the side element parts 103', 103" and interconnection hinge 112 will in those cases where the module 100 or the beam structure 400 is only mounted at one end, themselves thereby pick up tension forces on the top face of the module 100 or the modular beam structure 400.

Figure 8:
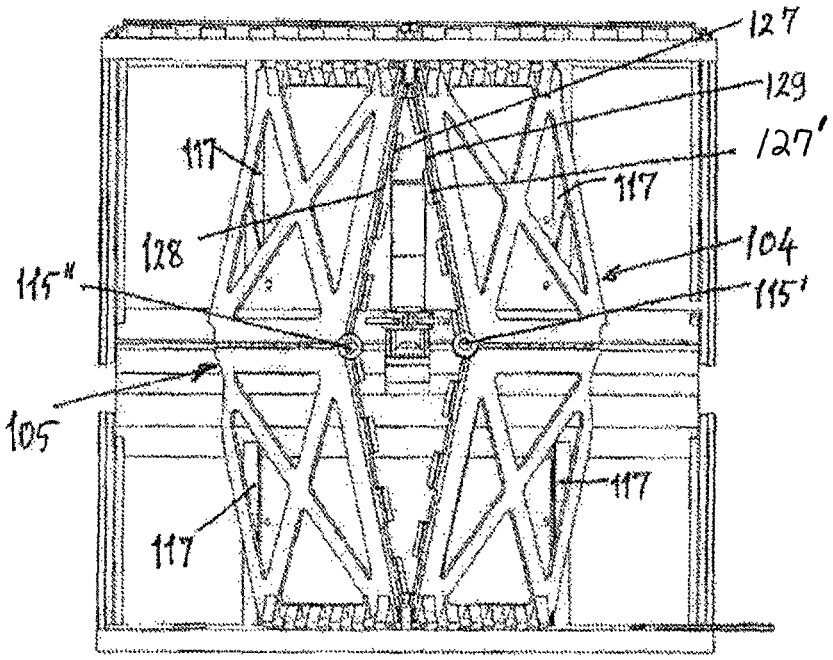
FIG. 8 shows in plan view the structure module viewed from below, and in partly unfolded state.
Figure 9:
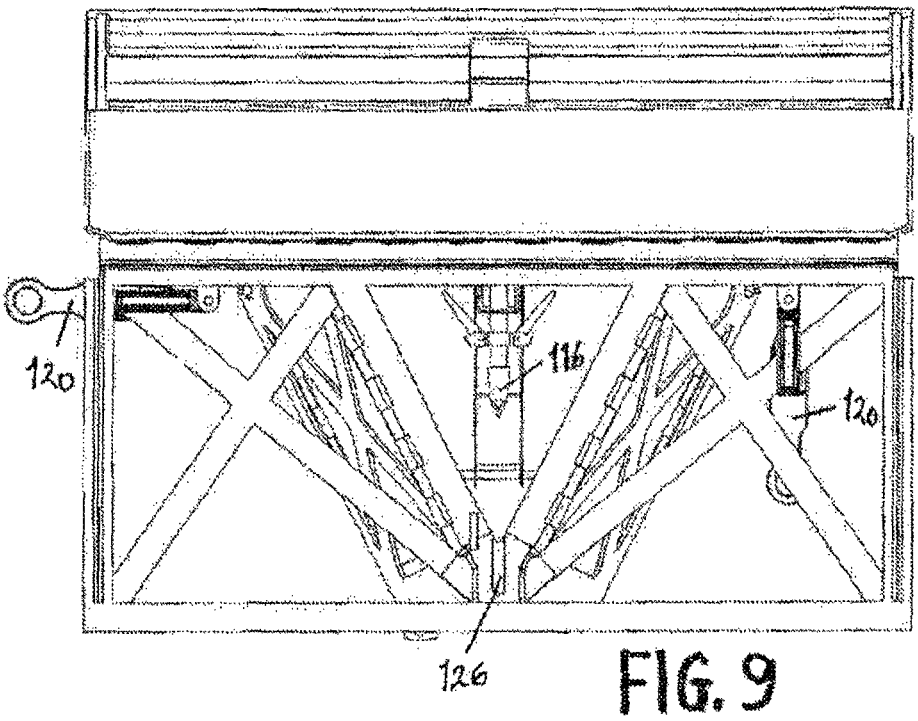
FIG. 9 shows the structure module in vertical view and viewed from said second end thereof, and in partly unfolded state.

In will be observed inter alia on FIG. 8 that the lowermost edge of the side elements 104; 105 are provided with pegs 127; 127' engaging into voids 128; 129, respectively, on adjacent side element 105; 104. This contributes also to an improved structural stability, as it is with application of force on the structure thereby prevented mutual sliding of the side elements 104, 105 and thereby extra stress on the connection between the locking peg 116 and the locking ears 115', 115".

By letting the module end elements 101, 102 having a framework configuration, as shown, there is obtained elements 101, 102 which are satisfactorily braced.

It is possible to imagine that for a structure 400, where it is not required to have laterally attached modules or platforms or railing, use of module end elements 101, 102 may be dropped in order to reduce weight and volume. This will then demand some changed way of interconnection of modules, and will also for some embodiments yield reduced rigidity of such a structure relative to using module end elements as shown and described.

The collapsible, elongate, modular beam structure 400 is now to be further described with primary reference to FIGS. **24*a*-27, secondly with reference to FIGS. 28-31, and further in an additional modification with reference to FIGS. 32-35**.

As it appears primarily from FIGS. **24*a*-27 it is there, only as example, shown a beam structure 400 which consists of three interconnected modules 100, and an additional attached, but not yet unfolded and locked module 100. Interconnection has been made as explained in connection with functionalities of the module 100. Thus, the beam structure comprises an arrangement in longitudinal direction of interconnectable support structure modules 100** configured as previously described.

The interconnection is made by having a second upright, rigid module end element 102 on one module 100 attached to a first upright, rigid module element 101 on an adjacent, next module 100 in the arrangement by use of male-female connection and/or bolt connection. Bolt connection is normally not required, but may be made available due to possible extra security considerations or due to other reasons.

In order to render possible suspension of such a beam structure onto an attachment device 402, e.g. a vertical or inclined wall or satisfactory anchored support block, there is provided a support frame 401 having a pair of female engagement elements 401', such as e.g. wedge shaped tracks, intended to receiving wedge shaped male engagement elements 101" on the module end element 101 which becomes adjacent the location of suspension or the attachment device 402, i.e. for example the wall or the support block. The support frame 401 is attached to the suspension location by means of e.g. a plurality of bolts 403 which are satisfactorily anchored, e.g. with cast-in or attached anchors 403'.

It will be noted that the support frame 401 has an engagement track 404 which is intended to co-operate with the engagement peg 125 (see FIGS. 1, 3, 6, 7, 10, 11 and 12) which is on the module end element 101 which is the one most adjacent to the support frame 401.

Figures 24A, 24B, 25:
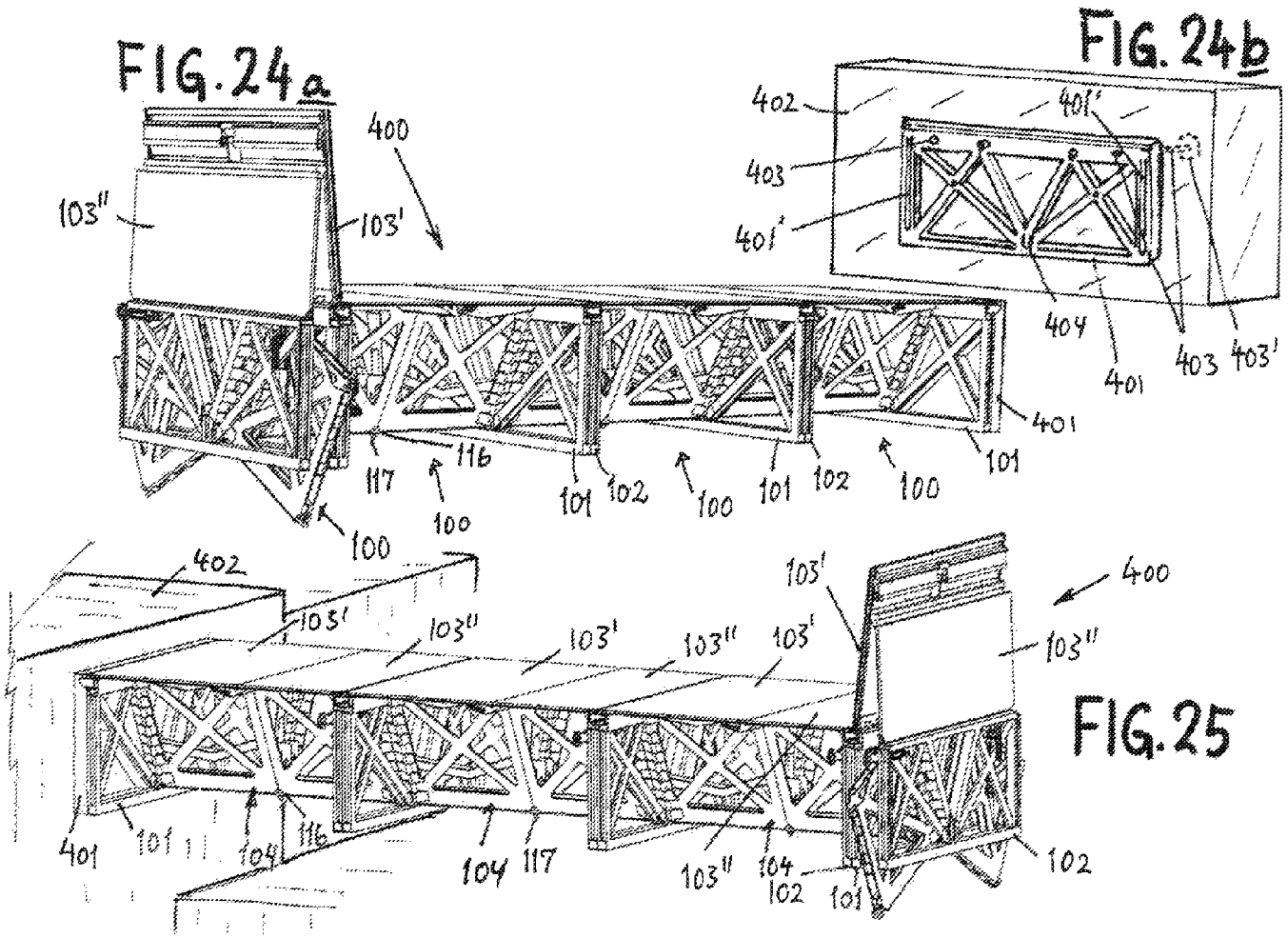
FIG. 24*a* shows a modular beam structure, according to the invention, in perspective view from above, one side and an end which is ready to be expanded.
FIG. 24*b* shows a support frame for a beam structure, the support frame being anchored to a securing device.
FIG. 25 shows the modular beam structure in perspective view from above, a second side and an end which is ready to be expanded.
Figure 26:
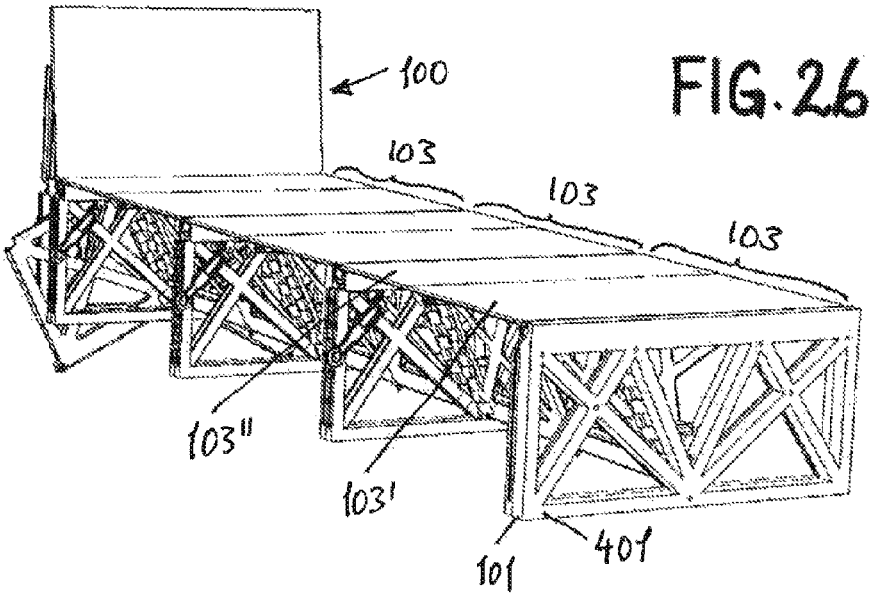
FIG. 26 shows the beam structure in perspective view from above, said second side and an end which is intended to be attached to an anchoring device, e.g. a wall.

As it clearly appears from FIGS. 25-27, the uppermost 103 of the side elements of the respective modules 100 in the beam structure 400 will have a surface which can be configured so that it e.g. can support a movable vehicle or support human beings or animals which are present on the upward facing surface of the two element parts 103', 103" of the side element 103. In order to safeguard that neither human beings, nor animals, nor vehicles skid on the surface, the surface can exhibit friction coating, ribs in a grid net, or other suitable anti-skid means.

By letting the structure 400 at one end thereof (upstream end) be attached in the manner shown to an attachment device 402, e.g. attachment block or wall, via a module end element 101 being attached to the support frame 401, the structure 400 will constitute a cantilevered beam.

It is also possible to envisage that the beam structure also at an opposite end (downstream end) is attached to an upright attachment device, e.g. an attachment block or a wall, via a module end element. In such a case it must be certain that the outermost end of the support structure obtains a stable attachment, and in this case there may be a need for a transition frame (not shown) with male engagement elements on both sides thereof, partly for engagement with female engagement elements 102' on a module element 102 of an outermost module 100 and female engagement elements 401' on a support frame 401. In addition there may be a need for additional securing by use of bolts or set-screws. It is also possible to imagine at a respective end of the beam structure 400 to let a module end element 101, 102, respectively, rest thereat and be in engagement with a fixed foundation (not shown). It is also possible to imagine that the beam structure 400 can be attached to an upright attachment device at one end via a module end element (e.g. 101) thereat and at another end via module end element (e.g. 102) resting on and engaging a fixed foundation.

Although there is in the figures indicated that the beam structure in stretched-out posture is substantially parallel with a horizontal plane, it should be appreciated that the beam structure in stretched-out posture alternatively could be arranged at an angle to the horizontal plane.

FIGS. 28-31 illustrate how a structure 400 as shown on FIGS. 24*a*-27 can be provided with side walls 500 and which through use of male engagement elements (not visible on the figures) on wall post 501 can be hooked into engagement with female engagement elements 101', 102' on the laterally outward facing sides on the module end elements 101, 102. The posts 501 are suitably divided in two in post parts 501', 501". The wall panels can e.g. consist of complete plates 502 or plate parts, possibly netting or expanded metal. The post parts 501', 501" and the wall 502 which is related to the individual module 100 is suitably uppermost connected to a stay 503 and lowermost correspondingly connected to a stay 504. Stays 505 between the post parts may also be arranged on the rear side of the wall.

The post parts, the wall and the stays will together contribute to increased structural rigidity and extra securing against the individual module, upon unintentional incorrect loading, steps out of self-locking (inter alia the engagement parts 115, 116).

In addition, the railing or the fence will yield traffic or staying on the surface of the structure 400 to become safe and that there is prevented falling of any loose objects, e.g. tools or other equipment. Such railings can also function as connection locations for safety line for persons who are on the top face of the structure.

There is on FIGS. 32-35 shown a modified beam structure in which at least at one transition location between two modules in the structure 400, there is installed, in longitudinal direction of the structure, an angled transition module 200 of a type as shown and explained in connection with FIGS. 15-20, whereby a change of the longitudinal direction of the structure is enabled.

It is also seen from FIGS. 32-35 that the structure 400 can be extended transverse of its longitudinal direction by hooking onto side portions of a module 100, i.e. in longitudinal direction of the structure, the collapsible platform 300. As indicated above, it is also possible to let the structure be extended laterally by at least one module 100 which is attached to longitudinally extending side of a module 100 arranged in longitudinal direction of the structure.

The uppermost of the side elements 103', 103"; 203', 203" on the respective modules 100; 200 in the beam structure can be configured to support devices which conduct fluid and/or electricity. However, this is not shown on the drawing figures.

Although the transition module is shown for making an angle in longitudinal direction of the beam structure, it is also in certain cases possible to imagine that the transition module is configured without angle between the module end elements 201; 202. It will, however, be observed that the transition module 200 does not exhibit the same locking possibilities as for the module 100, i.e. locking peg 116 in co-operation with locking ears 115', 115". When using such a transition module 200 it may therefore be important to cause that it is supported or has suspension (like e.g. suspension 120), possibly that neighbouring modules have such support or such suspension, in order that there cannot by accident occur an unexpected collapse of the transition module, even though the engagement pieces or pegs 215; 216 and the dead centre mechanism 212 normally will prevent that this will occur.

Although the beam structure 400 as an outset is considered to be a cantilevered beam, a beam which is supported or suspended at one or more locations along its length, and where the beam can form base for a place to stay or a path for movement, it is also possible to imagine that the beam structure can e.g. be used as support beam for a roof structure. In reality, the fields of use are numerous both for the modules and the beam structure, and accessories like platform and/or fence/railing. An expert in the art will therefore easily find other fields of use than those indicated here.

The invention claimed is:

1. A collapsible, elongate support structure module, wherein the module is configured to form a beam or part of a modular beam structure, the module comprising:

an uppermost side element comprising a first element part and a second element part having opposite edges which are hinge connected to each other via a first hinge connection, the two element parts being located in a common plane when the module is completely unfolded and stretched-out, wherein the module has:

a) first and second upright, rigid module end elements, and b) two further side elements, and wherein the uppermost side element and the two further side elements extend between the module end elements with an adjacent one of the uppermost and the two further side elements forming an acute angle with each other when the module is completely unfolded such that the two further side elements are in converging relationship, each of the uppermost side element and the two further side elements in a longitudinal direction having a first extreme end and a second extreme end, respectively, which are hinge connected to the first and second module end elements, respectively, and each of the two further side elements being constituted by a first element part and a second element part which, between the extreme ends, are hinge connected to each other via a respective second hinge connection to enable rotation of the first and second element parts toward or away from one another, the first and second element parts of each of the two further side elements being located in a common plane when the module is completely unfolded and stretched-out, wherein each element in the further two side elements has a longitudinal lower edge to provide a pair of abutting lower edges which are configured to make co-operating engagement at a location wherein a releasable locking device is configured to maintain the converging relationship between the two further side elements; and wherein the first hinge connection is configured with a pivot axis which moves relative to the opposite edges of the first element part and the second element part of the uppermost side element, and which permits the opposite edges of the first element part and the second element part to move between spaced apart and adjacently disposed positions.

2. The module according to claim 1, wherein the uppermost side element has an upper surface being level with an upper edge face of each of the respective module end elements.

3. The module according to claim 1, wherein the module end elements on upright side faces in an unfolding direction of the module and transversely of the unfolding direction have engagement elements configured for engagement with co-operating module end engagement elements on:

a) a corresponding module which is arranged to extend in the longitudinal direction of a beam structure or laterally, transverse of the longitudinal direction of the structure, or b) a transition module which is insertable in a beam structure and is configured to thereby cause change in a direction of a length extent of the structure, or c) a platform which is configured to extend out from one end of the beam structure or transversely of the longitudinal direction of the structure, or d) posts of railing or fence for placing along one or more modules in the longitudinal direction of the beam structure.

4. The module according to claim 1, wherein the uppermost side element of the module has the first hinge connection located midway configured as a dead center mechanism, and wherein opposite edges of the first and second element parts of the uppermost side element at the first hinge connection, are configured with co-operating male and female members.

5. The module according to claim 1, wherein the first and second element parts of the uppermost side element exhibit at respective longitudinal side regions thereof downward protruding engagement pieces configured for engagement with at least one upper side face portion of a respective adjacent element part of a neighboring side element located below the uppermost side element.

6. The module according to claim 1, wherein the releasable locking device is a locking peg which is connected by a link arrangement to the first hinge connection and to one of the module end elements, and wherein the locking peg is configured for co-operating engagement with a respective locking ear arranged at a lower edge on the two further side elements located below the uppermost side element, the adjacent lower edges converge so that the two respective locking ears align to simultaneously engage the locking peg.

7. The module according to claim 1, wherein a cross-section of an assembly of the uppermost side element and the two further side elements exhibit a triangular configuration when the module is completely unfolded.

8. The module according to claim 1, wherein the module end elements each have a rectangular configuration.

9. A collapsible, elongate support structure module, wherein the module is configured to form a part of a modular beam, and wherein the module has an uppermost side element comprising a first element part and a second element part which, at a location between extreme ends of the first and second element parts of the uppermost side element, are hinge connected to each other via a first hinge connection, the first and second element parts being located in a common plane when the module is completely unfolded and stretched-out, and wherein the module has:

a) first and second upright, rigid module end elements, and b) two further side elements which extend between the first and second module end elements, each module side element in a longitudinal direction having a first extreme end and a second extreme end which are hinge connected to the first and second module end elements, respectively, and each of the two further side elements being constituted by a first element part and a second element part which, between the extreme ends of the two further side elements, are hinge connected to each other via a respective second hinge connection to enable rotation of the first and second element parts toward or away from one another, the first and second element parts of each of the two further side elements are located in a common plane and are configured to prevent inward rotation towards each other when the module is completely unfolded and stretched-out, wherein the uppermost side element of the module has opposite edges of the first and second element parts configured at the first hinge connection with co-operative male and female members, the first hinge connection being configured as a dead center mechanism, wherein the uppermost side element has a substantially trapezoidal shaped configuration when the module is completely unfolded, and wherein the two further side elements of the module have different lengths when unfolded and are parallel, in an unfolding direction of the module and wherein the module end elements are spaced apart in non-parallel relationship by the two further side elements, and form a mutual angle with the two further side elements which is selectable in the range of 5°-45°.

10. The module according to claim 4, wherein the first hinge connection includes a hinge leaf which extends from an underside of the first element part of the uppermost side element, and is pivotally connected to the female member.

11. The module according to claim 1, wherein the first hinge connection provides a first pivot point, when the first element part and the second element part of the uppermost side element are in the common plane, which is located closer to an underside of the first element part than a distance of a second pivot point of the first hinge connection from the underside of the first element part.

12. The module according to claim 1, wherein the lower edges of the further two side elements are provided with a cooperating peg and void arrangement configured to prevent mutual sliding movement of the further two side elements.

13. The module according to claim 1, wherein undersides of the first element part and the second element part of the uppermost side element are provided with engagement structure configured to engage against the two further side elements to prevent collapse of the module when the module is completely unfolded.

14. The module according to claim 9, wherein undersides of the first element part and the second element part of the uppermost side element are provided with engagement elements engageable with the two further side elements for preventing collapse of the module when the module is completely unfolded.

15. The module according to claim 9, wherein the module end elements each have a rectangular configuration.

16. A collapsible, elongate modular beam structure comprising in a longitudinal direction thereof a plurality of interconnectable support structure modules which are configured to form a beam or part of a modular beam structure, each module comprising:

an uppermost side element comprising a first element part and a second element part having opposite edges which are hinge connected to each other via a first hinge connection, the first and second element parts being located in a common plane when the module is completely unfolded and stretched-out, wherein the module has:

a) first and second upright, rigid module end elements, and b) two further side elements, and wherein adjacent ones of the uppermost side element and the two further side elements extending between the module end elements form an acute mutual angle with each other when the module is completely unfolded such that the two further side elements are in converging relationship, each of the uppermost side element and the two further side elements in a longitudinal direction having a first extreme end and a second extreme end which are hinge connected to the first and second module end elements, respectively, and each of the two further side elements being constituted by a first element part and a second element part which, between the extreme ends, are hinge connected to each other via a second respective hinge connection to enable rotation of the first and second element parts toward or away from one another, the first and second element parts of each of the two further side elements being located in a common plane when the module is completely unfolded and stretched-out, wherein the two further side elements abut each other at a lower edge region thereof and make co-operating engagement at a location, and wherein a releasable locking device is configured to maintain the converging relationship between the two further side elements;

wherein in successive pairs of the modules a second upright, rigid module end element on one module is attachable to a first, upright, rigid module end element on a neighboring, next module of the structure by use of at least one of a male-female connection and a bolt connection to make co-operating engagement along one or a plurality of locations of the structure, and wherein the releasable locking device is provided in each module of the structure and is configured to maintain the converging relationship between the two further side elements; and wherein the first hinge connection is configured with a pivot axis which moves relative to the opposite edges of the first element part and the second element part of the uppermost side element, and which permits the opposite edges of the first element part and the second element part to move between spaced apart and adjacently disposed positions.

17. The beam structure according to claim 16, wherein the structure at one upstream end thereof is attachable to an upright attachment device via the first module end element and a support frame attached to the attachment device, such that the structure forms a cantilevered beam.

18. The beam structure according to claim 16, wherein at least at one transition location between two modules of the structure there is fixedly insertable, in a longitudinal direction of the structure, an angled transition module for changing the longitudinal direction of the structure.

19. The beam structure according to claim 16, wherein the structure is expandable transversely of a longitudinal direction thereof by hooking a collapsible module or a collapsible platform onto a module side portion of the structure.

20. The module according to claim 16, wherein the first hinge connection includes a moveable hinge leaf which extends from an underside of the first element part of the uppermost side element.

* * * * *